US009049927B2

(12) United States Patent
Wadud

(10) Patent No.: US 9,049,927 B2
(45) Date of Patent: Jun. 9, 2015

(54) READING STAND

(76) Inventor: Jabir Wadud, Newark, NJ (US)

( * ) Notice: Subject to any disclaimer, the term of this patent is extended or adjusted under 35 U.S.C. 154(b) by 687 days.

(21) Appl. No.: 13/436,682

(22) Filed: Mar. 30, 2012

(65) Prior Publication Data

US 2013/0136288 A1 May 30, 2013

Related U.S. Application Data

(60) Provisional application No. 61/563,727, filed on Nov. 25, 2011.

(51) Int. Cl.
*H04R 9/06* (2006.01)
*A47B 23/06* (2006.01)

(52) U.S. Cl.
CPC . *A47B 23/06* (2013.01); *H04R 9/06* (2013.01)

(58) Field of Classification Search
CPC ..... H04R 1/02; H04R 1/025; H04R 2499/11; H04R 1/021; H04R 9/06; H04S 1/002; H04S 7/303; H04S 7/00; F16M 13/00; F16M 11/10; F16M 11/06; F16M 11/12; F16M 11/18; F16M 11/2021; F16M 11/22; F16M 11/24; F16M 11/38; F16M 2200/024; A47B 97/04; G10K 11/16; G10K 15/08; G06K 1/16; G06K 1/1613; G06K 1/1626; G06K 1/1632; G06K 1/1658; H04M 1/6075; H05K 7/00; H05K 13/0023; H05K 5/0017; H05K 5/0234
USPC ..... 381/87, 332–334, 336, 91, 122, 300, 381/301, 303, 304, 305, 306, 307; 248/441.1, 442, 442.2, 443, 444, 445, 248/446, 447, 447.1, 447.2, 448, 449, 450, 248/452, 453, 454, 457, 458, 462; 84/481
See application file for complete search history.

(56) References Cited

U.S. PATENT DOCUMENTS

| | | | | | |
|---|---|---|---|---|---|
| 2,579,740 | A | * | 12/1951 | Hiemenz | 248/455 |
| 2,916,848 | A | * | 12/1959 | Schlachter | 281/33 |
| 3,768,768 | A | * | 10/1973 | Benlian | 248/456 |
| 3,813,074 | A | * | 5/1974 | Mulvaney | 248/452 |
| 3,950,793 | A | * | 4/1976 | Adams | 4/559 |
| D246,016 | S | * | 10/1977 | Brady | D6/419 |
| 4,120,564 | A | * | 10/1978 | Rios | 359/806 |
| 4,274,616 | A | * | 6/1981 | Radtke | 248/459 |
| 5,025,353 | A | * | 6/1991 | Menaged | 362/98 |
| 5,263,865 | A | * | 11/1993 | Zipf | 434/309 |
| 5,284,256 | A | * | 2/1994 | Correll-Antoun | 211/42 |
| 5,393,029 | A | * | 2/1995 | Senko | 248/447 |

(Continued)

FOREIGN PATENT DOCUMENTS

| | | |
|---|---|---|
| CN | 2075472 | 4/1991 |
| KR | 10-210-0115827 | 10/2010 |

*Primary Examiner* — Leshui Zhang
(74) *Attorney, Agent, or Firm* — Richard C. Litman

(57) ABSTRACT

The reading stand includes a base, a book support adjustably mounted to the base, a timer module disposed on the book support, and a multimedia player disposed on one side of the book support. The book support can be horizontally adjusted with respect to the base in order to accommodate larger books and reading material and vertically adjusted for user comfort. Additionally, the book support can be adjustably tilted to various angles for setting a comfortable viewing angle for the user. The timer helps the reader to keep track of the reader's reading skills and progress, while the multimedia player can be used to listen to lessons from digital media, such as a compact disc.

20 Claims, 5 Drawing Sheets

(56) References Cited

U.S. PATENT DOCUMENTS

| | | | | | |
|---|---|---|---|---|---|
| 5,582,382 | A | * | 12/1996 | Pan-Yang | 248/456 |
| 5,651,525 | A | * | 7/1997 | Yang | 248/456 |
| 5,690,310 | A | * | 11/1997 | Brown | 248/448 |
| 5,720,465 | A | * | 2/1998 | Peltzer et al. | 248/453 |
| 5,971,343 | A | * | 10/1999 | Marlak | 248/441.1 |
| 6,736,531 | B2 | | 5/2004 | Wallach | |
| 7,939,739 | B1 | * | 5/2011 | Sadegh et al. | 84/486 |
| 2003/0183738 | A1 | * | 10/2003 | Weingartner | 248/453 |
| 2004/0041067 | A1 | * | 3/2004 | Jung | 248/444.1 |
| 2007/0258335 | A1 | | 11/2007 | Farinella et al. | |
| 2009/0166504 | A1 | * | 7/2009 | Lorenzatti | 248/444.1 |
| 2012/0080581 | A1 | * | 4/2012 | Chang | 248/458 |

* cited by examiner

READING STAND

CROSS-REFERENCE TO RELATED APPLICATION

This application claims the benefit of U.S. Provisional Patent Application Ser. No. 61/563,727, filed Nov. 25, 2011.

BACKGROUND OF THE INVENTION

1. Field of the Invention

The present invention relates to educational tools, and particularly to a reading stand that provides a convenient study platform and tools for improving reading skills.

2. Description of the Related Art

Reading is a basic skill that everyone in the world should possess. It is a form of communication that provides a solid foundation for imparting knowledge through formal education, expands the scope of the individual's environment through stories both fictional and non-fictional, and permits individuals to stay abreast of personal and worldly matters through letters, newspapers, emails, internet and the like.

For many who are developing their reading skills, studying, or reading for entertainment, there does not appear to be many tools to help make it a comfortable experience, much less one that actively invites one to improve. Most conventional book or reading stands are ones that can be placed atop a desk. They include a support base and a reading material support top usually disposed at an angle conducive for reading. These work well as a basic support for the book and other reading materials. However, they usually lack some convenience features, such as a means for keeping the pages open, especially for new and stiffly bound books, or a means to adjust the support top to a user's liking. While portable, this type of a conventional reading stand cannot be used for extended periods of reading without discomfort when the user sits or reclines on a floor, couch or bed.

There are other portable stands that are more comfortable for those sitting or reclining situations noted above, such as the current laptop desks and the like. One common variation includes a flat support for a laptop computer or reading materials and a cushioned back for comfortable placement on the user's lap. Another variation includes support legs that provide room between the support legs to place the stand over the user's lap. While comfortable, most do not include an angled support. Those that have an angled support usually do not have adjustable capability, or are limited in the adjustment range thereof.

One technique that educators utilize currently to improve one's reading and comprehension skills is to set timed goals on the material one reads. For example, the reader can set a goal of reading twenty pages in one-half an hour. Once met, the reader can improve by increasing the number of pages to read within the same set period, or further modify the parameters of time and pages. This can be facilitated by using conventional stopwatches or other timekeeping devices. However, it does not appear that any of the typical reading stands includes such timers.

In light of the above, it would be a benefit in the art of education tools to provide a reading stand that is comfortable to use and that includes integrated features for promoting study and improved reading skills. Thus, a reading stand solving the aforementioned problems is desired.

SUMMARY OF THE INVENTION

The reading stand includes a base, a book support adjustably mounted on the base, a timer module disposed on the book support, and a multimedia player disposed on one side of the book support. The book support can be horizontally adjusted with respect to the base in order to accommodate larger books and reading material and vertically adjusted for user comfort. Additionally, the book support can be adjustably tilted to various angles for comfortable viewing angle for the user. The timer helps the reader to keep track of the reader's reading skills and progress, while the multimedia player can be used to listen to lessons from digital media, such as a compact disc.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
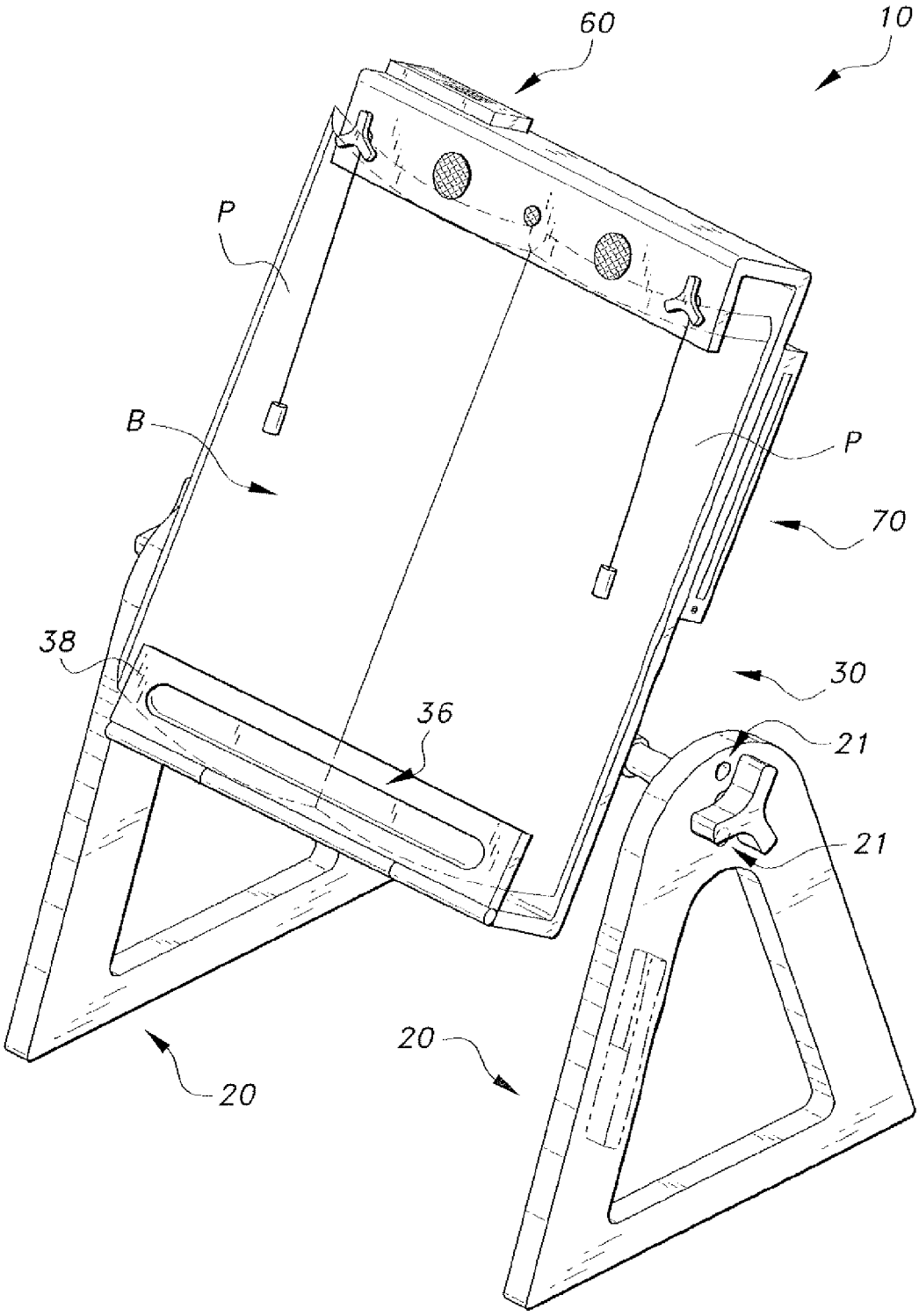
FIG. 1 is an environmental, perspective view of a reading stand according to the present invention.
Figure 2:
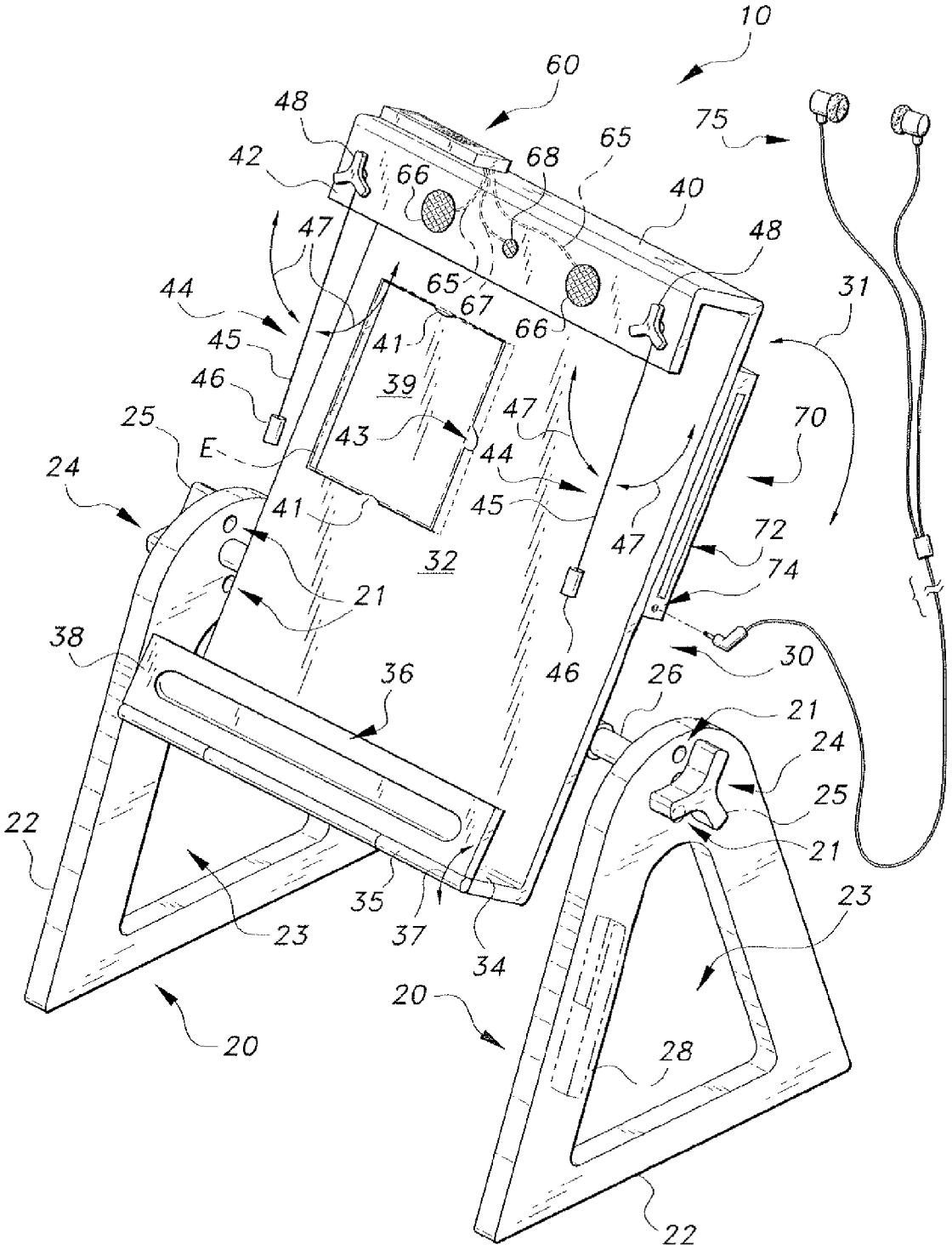
FIG. 2 is a front perspective view of the reading stand according to the present invention.
Figure 4:
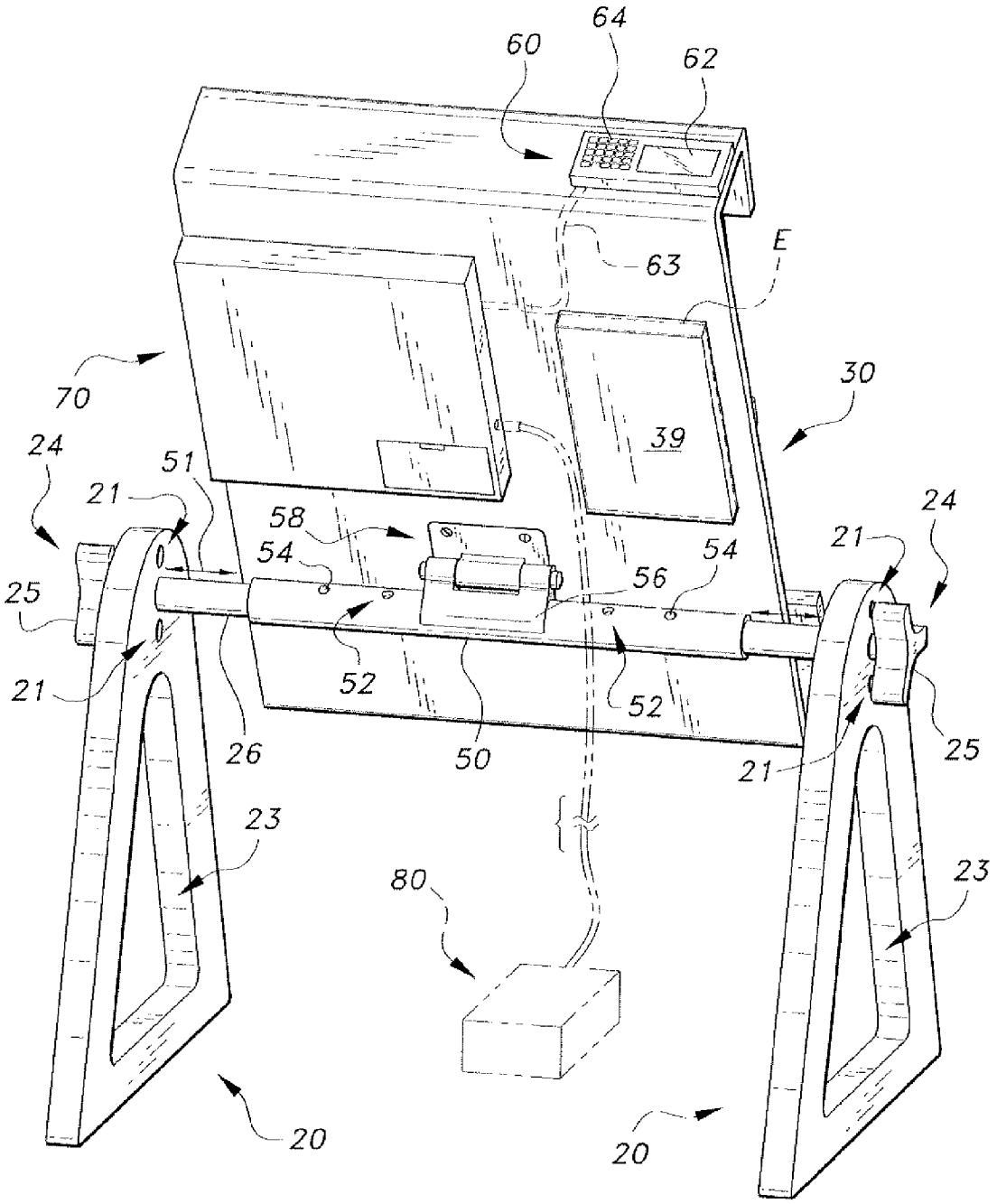
FIG. 4 is a rear perspective view of the reading stand of FIG. 2, showing details thereof.

The reading stand, generally referred to in the drawings by the reference number 10, is a lightweight educational tool that provides a comfortable platform for reading, studying and integrated tools to help improve a user's reading skills. As shown in FIGS. 1, 2 and 4, the reading stand 10 includes a base 20, a book support 30 adjustably mounted to the base 20, a timer module 60 disposed on the book support 30 and a multimedia player 70 disposed on one side of the book support 30.

The base 20 includes a pair of support legs 22 mounted to opposite ends of a support beam, bar or rod 26 by fasteners 24. The length of the support beam 26 and the corresponding spacing of the support legs 22 are preferably wide enough to easily accommodate the laps of individuals ranging from children to adults. Each support leg 22 is triangular in shape to provide a stable support for placing the reading stand 10 on a surface. Additionally, each support leg 22 can be formed with a matching triangular cutout 23 to reduce the weight thereof without compromising the stability of the support leg 22. The fasteners 24 for attaching the support legs 22 to the support beam 26 can include a thumbscrew having a knob 25 for easy manipulation by the user. The knob 25 can be a three-point knob that can be easily grasped by the user to tighten or loosen the mounting of the support legs 22. Other similar fasteners can be used to attach the support legs 22, such as thumbscrew fasteners with circular knobs having grooves around the circumference, snap-fit type fasteners for quick and easy assembly and disassembly and the like. Alternatively, the fasteners 24 can be a variety of screw-type fasteners requiring a tool to fasten the legs 22. One or both of the support legs 22 can also include a pocket or compartment 28 for holding writing instruments, reading glasses, and other office-type pendants. The pocket 28 can be integrally formed on or detachably mounted to the support leg 22, e.g., by hook and loop fasteners.

The book support 30 includes a substantially flat platform or base 32 having a lower shelf or ledge 34 and an upper shelf or ledge 40 extending outward from opposite ends of the base 32. The base 32 supports the back of a book B or reading material placed on the book support 30, while the lower shelf 34 supports the bottom edge of the book B. In order to insure that the book B stays in place, the lower shelf 34, 40 includes a lower lip or extension 38, and the upper shelf 40 includes an upper lip or extension 42. The upper lip 42 is integral with the upper shelf 40 and extends at an angle towards the base 32. Similarly, the lower lip 38 is also normally disposed at an angle with respect to the lower shelf 34 towards the base 32. Once the book B is placed on the book support 30, the lower lip 38 and the upper lip 42 prevent the book B from sliding out perpendicularly with respect to the base 32 by providing a lower abutment for the lower portion of the book B and an upper abutment for the upper portion of the book B. Moreover, the lips 38, 42 keep the book B open.

Figure 3:
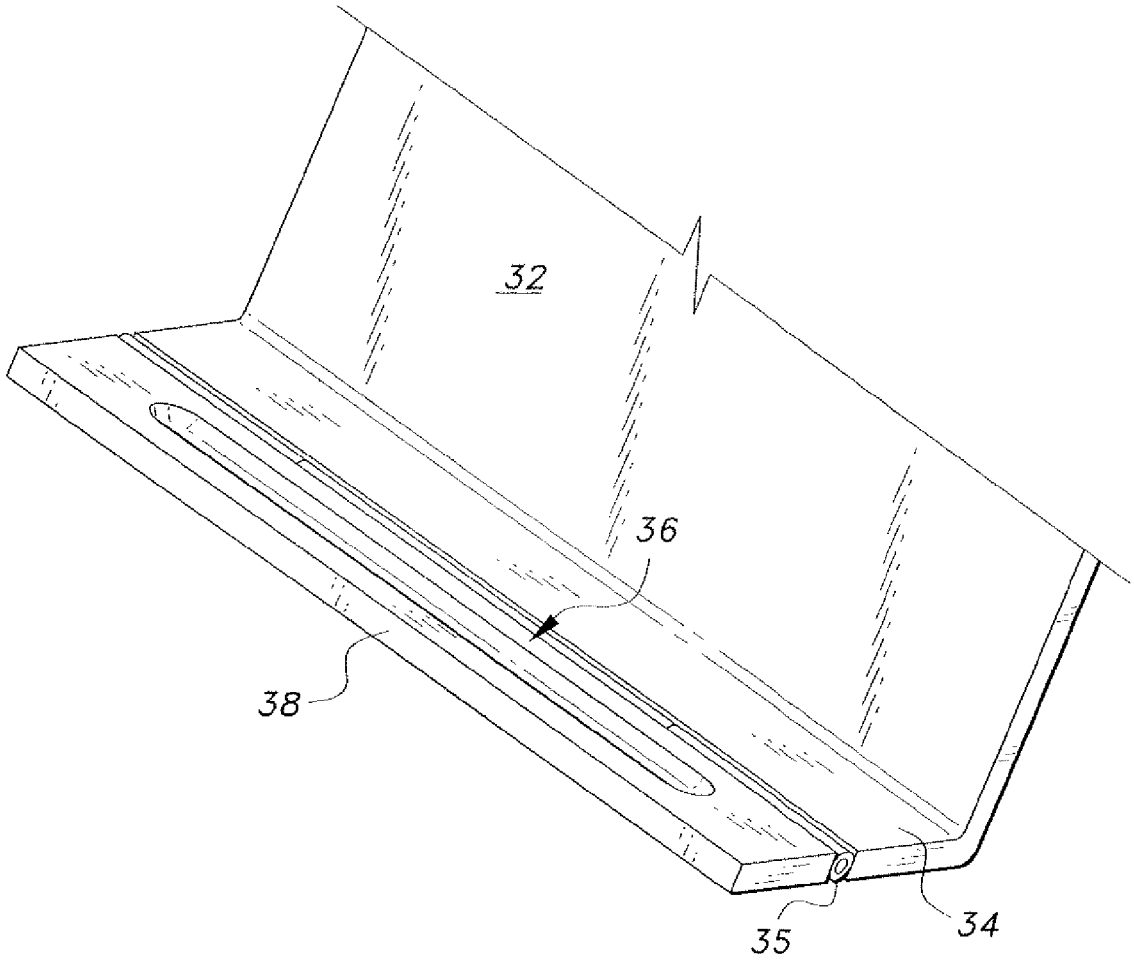
FIG. 3 is a partial perspective view of the reading stand shown in FIG. 2, providing an enlarged view of the lower shelf.

In addition to the above, the lower shelf 34 also includes additional convenience features. As shown in FIGS. 1-3, the lower lip 38 is pivotally attached to the lower shelf 34 by a friction hinge 35, the folding motion indicated by the arrow 37. The lower lip 38 is normally folded to the upright position described above, but can be unfolded to accommodate large or thick books. The friction hinge 35 assists in maintaining the folded or unfolded positions of the lower lip 38. In addition, the lower lip 38 includes a longitudinal groove 36 formed thereon so that electronic readers E, such as Kindle®, Nook®, iPad® and similar devices, can be easily and conveniently supported in the groove 36 with unhindered access to controls that may be disposed towards the bottom of the electronic reader E.

Regarding electronic readers E, the base 32 can be provided with an alternative means for storing and using the reader E. As shown in FIGS. 2 and 4, the base 32 can include an electronic reader recess or depression 39 formed on the front of the base 32. The recess 39 allows the user to place the electronic reader E securely therein for normal reading, as well as for temporary storage. In order to insure that the electronic reader E is securely mounted inside the recess 39, resilient tabs 41 can be provided at select locations along the periphery of the recess 39. The tabs 41 provide a snap-fit engagement between the electronic reader E and the recess 39 when the user places the electronic reader E into the recess 39. This prevents the electronic reader E from inadvertently falling out of the recess 39. Alternative reader retainers, such as resilient clips or sliding locks, can be used in place of or in conjunction with the tabs 41 for similar secure installation. The dimensions of the recess 39 are preferably configured to accommodate electronic readers of various sizes. Depending on the thickness of the base 32, the recess 39 may be contained within the thickness or wall of the base 32, or may protrude from the rear face of the base 32, as shown in FIG. 4. If the electronic reader E is too thick for the recess 39, the resilient tab 41 and alternatives thereof can still engage the outer edge of the electronic reader E in order to retain the same. The recess 39 can also include a finger access slot 43, a groove, or a hole 43 to assist the user in manually removing the electronic reader E from the recess 39, especially with a snug fit engagement. It is to be understood that the recess 39 can be placed anywhere on the base 32.

The upper shelf 40 also includes features for assisting the reader. As shown in FIGS. 1, 2 and 5, the reading stand 10 includes page holders 44 adjustably mounted to opposite end portions of the upper lip 42. Each page holder 44 includes an elongate wire 45 attached at one end to the upper lip 42 by a fastener 48 and a decorative page-holding pendant 46 attached to the opposite end of the wire 45. The fasteners 48 can be thumbscrews or thumbwheels similar in construction to the fasteners 24 for easy manipulation thereof. Selective rotation of the fasteners 48 pivots the wire 45, as indicated by the arrows 47, to the desired, adjusted position, while the page-holding pendant 46 is placed against a page P of the open book B to prevent the page from moving, or to bookmark a particular page of the book B. Each page holder 44 can also be pivoted out of the way to allow page turning. To facilitate this page holding function of the page holder 44, each wire 45 can be constructed so that the wire 45 can be bent by the user as desired. The inherent resiliency of the wire 45 provides play that allows for easy placement by the user. The wire 45 can be constructed from various plastics and metals, and/or sheathed to protect the same from corrosion while maintaining structural integrity.

Figure 5A:
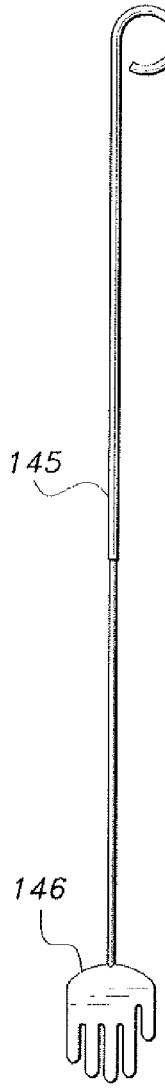
FIGS. 5A, 5B, 5C, 5D, and 5E are front views of alternative page holders for the reading stand of FIG. 2.
Figure 5B:
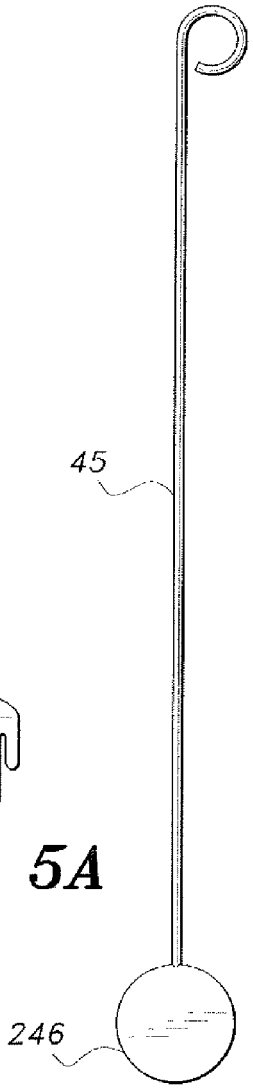
Figure 5C:
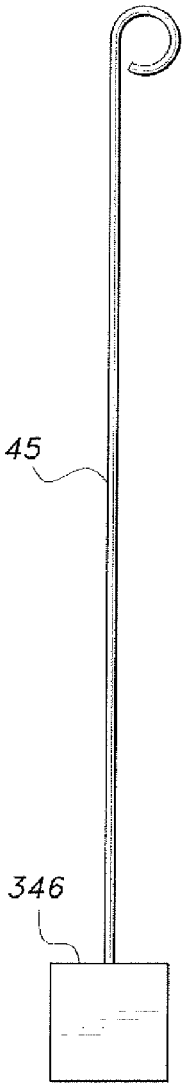
Figure 5D:
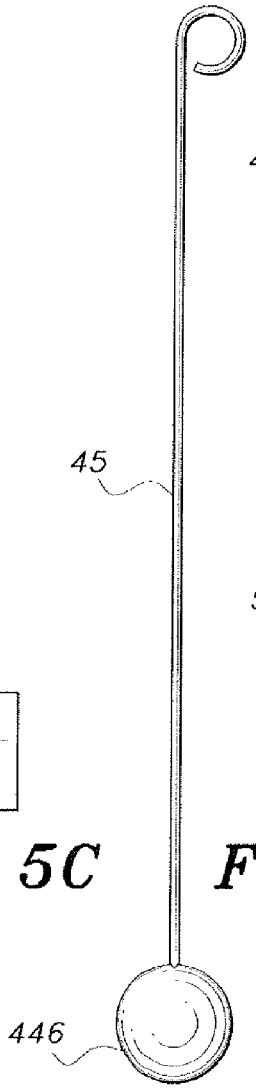
Figure 5E:
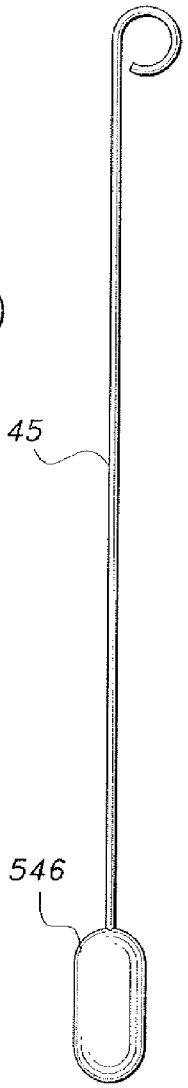

The page-holding pendant 46 can be a free, rotating roller. However, a variety of constructions can be used for the pendant 46, as exemplified by the alternative embodiments shown in FIGS. 5A-5E. As shown, the alternative pendants can include a hand-shaped pendant 146 (FIG. 5A), a flat circle pendant 246 (FIG. 5B), a flat square pendant 346 (FIG. 5C), a spherical pendant 446 (FIG. 5D), and/or a lozenge-shaped pendant 546 (FIG. 5E). It is to be understood that the above are only examples, and other shapes and sizes can be used to construct the page-holding pendant 46. Additionally, the page-holding pendant 46 can be provide with a layer of friction-enhancing material, such as rubber, silicone, polymer or the like, to help prevent the page P from moving. Alternatively, the pendant 46 can be constructed from such material.

The reading stand 10 also includes various features for adjusting the position of the book support 30. As shown in FIG. 4, the book support 30 is attached to the support beam 26 by a sleeve 50. The sleeve 50 can be a hollow tube slidably mounted to the support beam 26, the movement being indicated by the arrow 51. The sleeve 50 includes a plurality of apertures 52 and detents 54 in the support beam 26 that selectively engage the apertures 52 when the user slides the book support 30 to a selected horizontal position. Thus, the book support 30 can be adjustably positioned horizontally to accommodate large and wide books. Alternative fasteners and clamps, such as screw clamps and integrated C-clamps, can be used to set the horizontal position at any desired point along the support beam 26.

In addition to the above, the tilt angle of the book support 30 can be adjusted, as indicated by the arrow 31 in FIG. 2. As shown in FIG. 4, the book support 30 is attached to the sleeve 50 by a friction hinge 58. The hinge 58 is supported and mounted to the sleeve 50 by a bracket 56. The friction hinge 58 is preferably robust to support the weight of the book support 30 and the book B thereon while maintaining the desired tilted position of the book support 30.

In addition to the horizontal adjustment, the book support 30 can also be vertically adjusted as desired by the user. As exemplarily shown in FIGS. 1, 2 and 4, each support leg 22 can include a plurality of vertically spaced adjustment holes or bores 21 for mounting the support beam 26. The user can mount the support beam 26 between any corresponding spaced pair of adjustment holes 21 to set the desired height of the book support 30 in order to provide enough room for the user's legs or lap or set a comfortable height for reading. Alternatively, the vertical adjustment can be facilitated by other vertical adjustment means such as vertical slots in the support legs 22 for a sliding, locking mechanism at the ends of the support beam 26 or a ratchet mechanism, vertical adjustment of the base 20, or an extendable feature on the hinge 58. Thus, the combined horizontal, vertical and tilting adjustments allow the user to position the book support 30 at a desired comfortable position for extended reading sessions.

Besides the comfortable reading functions, the reading stand 10 also includes features for promoting development of the user's reading skills. As shown in FIGS. 1-4, the reading stand 10 includes a timer 60 disposed on the upper shelf 40 and a multimedia player 70 disposed on the back side of the book support 30. The timer module 60 includes a display 62 and a control pad 64. The display 62 can be an LCD (liquid crystal display) screen, a LED (light emitting diode) screen, or the like, either monochrome or color. The timer module 60 can be programmed by the control pad 64 to set timed reading goals, as mentioned above. In this manner, the reader can easily monitor his/her reading progress. Moreover, the control pad 64 can be used to program other functions, as will be further detailed below.

The multimedia player 70 includes a slot 72 and a headphone jack 74. The slot 72 is constructed to receive various digital media formats, such as CDs, DVDs and/or Blueray® discs. Current education systems utilize lessons recorded on such media in conjunction with normal textbooks. Moreover, much popular literature exists in digital audio format. Thus, the reading stand 10 allows the reader to listen to lessons or their favorite book via the multimedia player 70, either aloud from the speakers 66 mounted to the upper lip 42, or in private through headphones 75. The reading stand 10 can be provided with headphones 75 as part of an overall product, and the headphones 75 can range from in-ear models to the wireless variety including inline features for controlling the multimedia player 70. Furthermore, the multimedia player 70 can also include a recording function.

As mentioned above, the control pad 64 can be used to program and control various functions through a central processor (not shown) in the timer module 60. Inclusive of the stopwatch timekeeping functions, the control pad 64 can set and keep the current time and date to be displayed through the display 62. The control pad 64 also controls the various functions of the multimedia player 70, such as play, stop, pause, record, fast forward, fast backward and skipping tracks forward and backward with relevant information being displayed on the display 62. Moreover, a microphone 68 disposed on the upper lip 42 can be used to record the reader's voice reading the text out loud. This helps the reader and others to monitor the reader's pronunciation of the text. The storage for the recording can be provided by an internal digital storage (not shown) in the timer module 60 or by the media for the multimedia player 70. This type of recording can be controlled by the control pad 64. All the above functions are facilitated by the wire 63 connecting the timer module 60 with the multimedia player 70, wires 65 leading to the speakers 66 and the wire 67 leading to the microphone 68. The power for the timer module 60 and the multimedia player 70 can be provided by batteries, rechargeable batteries or AC 80.

Thus, it can be seen that the reading stand 10 includes many features that enhance comfort, convenience and promote study. The lightweight and sturdy construction allows the reading stand 10 to be placed securely anywhere with ease, while the lower and upper lips 38, 42 and the page holders 44 insure that the book B is open to the desired page and securely supported on the book support 30. This permits the user to multitask while reading. The timer module 60 and the multimedia player 70 enhance the educational experience and promote improved reading skills.

It is noted that the reading stand 10 includes a variety of alternatives. For example, in keeping with the lightweight feature of the reading stand 10, the reading stand 10 can be constructed from plastics, lightweight but sturdy wood and metals, composites and combinations thereof. Moreover, the book support 30 can include various cutouts to reduce weight. Furthermore, the knobs of the fasteners can be of various shapes. The page holder 44 can also be constructed so that the length thereof can be selectively extended or retracted in a telescoping manner, which provides additional user-defined adjustment for placing the same on a page. An example of such is shown in FIG. 5A with a telescoping wire 145. For fixed length page holders 44, the wire 45 can be a plurality of wires to provide extra stability. Although the timer module 60 is shown protruding from the upper shelf 40, the timer module 60 can be constructed to be integral and flush with the upper shelf 40. As a further alternative, the timer module 60 can be detachably mounted so the user can easily handle the timer module 60 for programming or connecting the same to a computer and the like. Furthermore, the multimedia player 70 can be provided anywhere on the reading stand 10 as long as it does not interfere with various functions of the stand 10. The reading stand 10 can also be provided in a variety of colors and indicia.

It is to be understood that the present invention is not limited to the embodiments described above, but encompasses any and all embodiments within the scope of the following claims.

I claim:

1. A reading stand, comprising:

a base adapted for supporting the reading stand on a surface;

a book support adjustably mounted to the base, the book support being adjustable to selectable horizontal, vertical and tilt positions for comfortable reading by a user, the book support having a base, an upper shelf and a lower shelf, an upper lip extending from the upper shelf at an angle towards the base of the book support and a lower lip extending from the lower shelf at an angle towards the base of the book support, the book support securely holding a book thereon;

at least a pair of page holders adjustably mounted to the upper lip, each of the page holders being selectively movable to hold a page down and movable out of the way for turning the page;

a timer module disposed on the upper shelf, the timer module having a display and a control pad, the timer module keeping time for monitoring a user's reading progress; and a multimedia player disposed on the book support, the multimedia player facilitating playing and recording of digital media, the control pad facilitating control of the multimedia player.

2. The reading stand according to claim 1, wherein said base comprises a pair of spaced, support legs, said book support being mounted between the support legs.

3. The reading stand according to claim 2, wherein each said support leg is substantially triangular in shape.

4. The reading stand according to claim 3, wherein each said support leg includes a shaped cutout for reducing weight.

5. The reading stand according to claim 3, further comprising at least one pocket disposed on at least one of said support legs.

6. The reading stand according to claim 2, further comprising an adjustable mounting assembly between said book support and said support legs for setting said desired horizontal, vertical and tilt position.

7. The reading stand according to claim 6, wherein said adjustable mounting assembly comprises:

an elongate support beam detachably mounted between said support legs;

a fastener at each end of the support beam for rigidly attaching each end of the support beam to one of said support legs, each of the support legs having a plurality of vertically aligned adjustment holes formed therein, the support beam being selectively mounted to a spaced pair of adjustment holes for setting the vertical position of said book support;

a sleeve slidably mounted on the support beam, the sleeve being selectively positioned on the support beam to set the horizontal position of said book support; and a hinge connecting said book support to the sleeve, the hinge being pivotal in order to set the tilt position of said book support.

8. The reading stand according to claim 7, wherein said sleeve has a plurality of apertures defined therein and said support beam includes a plurality of detents, the detents being selectively engageable with the apertures for incremental, horizontal positioning of said book support.

9. The reading stand according to claim 7, wherein said hinge comprises a friction hinge.

10. The reading stand according to claim 1, wherein said book support further comprises:

at least one speaker mounted to said upper lip, the at least one speaker facilitating auditory reproduction of digital media; and a microphone mounted to said upper lip, the microphone facilitating user-defined audio recording onto recording media.

11. The reading stand according to claim 1, wherein said lower lip is pivotally mounted to said lower shelf.

12. The reading stand according to claim 11, wherein said lower lip has at least one elongate groove formed on at least one side thereof.

13. The reading stand according to claim 1, wherein each of the page holders comprises an elongate wire, a fastener pivotally and detachably mounting one end of the elongate wire to said upper lip, and a page holding pendant attached to the opposite end of the elongate wire.

14. The reading stand according to claim 13, wherein said elongate wire is bendable into a desired shape for holding down the page.

15. The reading stand according to claim 13, wherein said elongate wire is selectively extendable to a desired length.

16. The reading stand according to claim 13, wherein said page holding pendant is a roller.

17. The reading stand according to claim 1, further comprising a headphone selectively connected to said multimedia player for private listening of recorded media.

18. The reading stand according to claim 1, wherein said base of said book support further comprises means for storing an electronic reader thereon.

19. The reading stand according to claim 18, wherein said means for storing the electronic reader comprises a recess formed on said base of said book support, the recess being dimensioned and configured to accommodate insertion of the electronic reader.

20. The reading stand according to claim 19, further comprising at least one resilient tab at select locations along a periphery of said recess, the recess having a finger access groove formed on a side of said recess, the at least one tab engaging the electronic reader to prevent the reader from inadvertently falling out of said recess.

* * * * *